US006202911B1

(12) United States Patent
Freer

(10) Patent No.: US 6,202,911 B1
(45) Date of Patent: Mar. 20, 2001

(54) BELT MOUNTED GOLF ACCESSORY ORGANIZER

(76) Inventor: Robert D. Freer, 3612 W. Foxes Meadow Dr., Tucson, AZ (US) 85745

( * ) Notice: Subject to any disclaimer, the term of this patent is extended or adjusted under 35 U.S.C. 154(b) by 0 days.

(21) Appl. No.: 09/301,224

(22) Filed: Apr. 29, 1999

(51) Int. Cl.[7] ..... A45F 5/00

(52) U.S. Cl. ..... 224/684; 224/223; 224/918; 224/919

(58) Field of Search ..... 224/191, 223, 224/664, 666, 668, 674, 676, 678, 680, 682, 684, 901.8, 918, 919, 932, 933; 206/315.1, 315.5, 315.9

(56) References Cited

U.S. PATENT DOCUMENTS

| | | | | |
|---|---|---|---|---|
| D. 332,176 | * | 1/1993 | Mueller | 224/919 X |
| D. 345,859 | | 4/1994 | Gribovsky . | |
| D. 376,687 | | 12/1996 | Carretta et al. . | |
| D. 393,948 | | 5/1998 | Cowlen . | |
| 1,648,565 | * | 11/1927 | Primley | 224/933 X |
| 2,558,382 | * | 6/1951 | Previdi | 224/918 X |
| 2,682,981 | * | 7/1954 | Previdi | 224/918 X |
| 4,498,615 | * | 2/1985 | Johnson | 224/918 X |
| 4,625,862 | * | 12/1986 | Clayton | 224/932 X |
| 4,804,121 | | 2/1989 | Stanton et al. . | |
| 4,848,624 | * | 7/1989 | Clem | 224/684 X |
| 4,886,196 | * | 12/1989 | Plummer | 224/918 X |
| 4,903,745 | * | 2/1990 | Roman | 224/668 X |
| 4,993,614 | | 2/1991 | Bonofiglo . | |
| 5,050,830 | * | 9/1991 | Hall | 224/918 X |
| 5,199,573 | | 4/1993 | Gribovsky . | |
| 5,269,410 | | 12/1993 | Abregano . | |
| 5,294,031 | * | 3/1994 | Volpei et al. | 224/664 X |
| 5,505,356 | * | 4/1996 | Noriega et al. | 224/680 X |
| 5,517,696 | * | 5/1996 | Krugler | 224/918 X |
| 5,772,090 | * | 6/1998 | Rodriguez | 224/918 X |
| 5,934,530 | * | 8/1999 | Antczak et al. | 224/918 X |

* cited by examiner

*Primary Examiner*—Gregory M. Vidovich
(74) *Attorney, Agent, or Firm*—Edward L. White

(57) ABSTRACT

A golf accessory organizer to be attached to a golfer's pants or belt. The golf organizer defines various pockets and storage elements therein for receiving a plurality of golf-related articles, such as golf balls, tees, score pencils, divot repair tools, and the like. A hook and loop panel is provided for releaseable attachment of a golf towel, a golf glove, a club face cleaning tool, and the like in contact with the organizer. Clips may be provided for easier attachment of the organizer to a golfer's pants or belt, not requiring the belt to be removed before the organizer is attached.

5 Claims, 2 Drawing Sheets

BELT MOUNTED GOLF ACCESSORY ORGANIZER

CROSS REFERENCE TO RELATED APPLICATIONS

None.

BACKGROUND OF THE INVENTION a. Field of the Invention

The present invention relates generally to devices for organizing golf accessories. More particularly, the present invention relates to devices intended to allow a golfer to organize golf accessories generally carried in a golfer's pocket including, for example, a golf glove and towel.

b. Description of the Prior Art

Organizers for golf accessories are well known. U.S. Pat. No. 5,199,573 to Gribovsky discloses a golf accessory organizer. The organizer disclosed by Gribovsky is a multi-fold device similar to a multi-fold wallet. It is intended to be carried in a pocket of the user. It is primarily intended as a storage space for a notepad, a golf score card, a golf score pencil, and a divot repair tool. U.S. Pat. No. 5,269,410 to Abregano also discloses a golf accessory organizer. Abregano's device also has storage spaces for various golf accessories, but has a clip which is intended to be fastened to the top cuff of a golf bag. Abregano's device is a flat square object for storage of tees and other articles provided in a small bag. U.S. Des. Pat. No. 393,948 to Cowlen is a golf accessory belt. The golf accessory belt is intended to be fastened around the top portion of a golf bag. It has a net device for storing golf balls, spaces to insert tees, and a space for a water bottle as well. It has a clasp mechanism with a belt which is intended to be fastened around the top of a golf bag. U.S. Pat. No. 4,804,121 to Stanton et al., is similar to the Cowlen patent discussed above. It is much simpler than the Cowlen device and discloses storage pockets, not specifically described for any particular purpose. The storage pockets are each multi-purpose and could store a variety of articles.

A related, but not altogether similar devices is disclosed in U.S. Pat. No. 4,993,614 to Bonofiglo disclosing a pocket member for a tool belt. Bonofiglo's device is a belt designed to be worn around the waist of a user for storing various construction tools such as hammers, screwdrivers, and the like. The storage pockets in the belt are integral. That is, the storage pockets cannot be used with any belt provided by the user. Rather, the pockets must be used with the belt which is integral therewith.

There is a need for a golf accessory organizer which can be used to store articles which are normally carried in a golfer's pocket. Prior art devices discussed above store these articles with the golf bag. This is inconvenient as a golfer and his golf bag are often separated, as when a golfer is riding in a cart. In those cases the accessories stored in the golf bag are not accessible to the golfer, and he must either carry them in his pocket or in his hand, and in either case it is inconvenient.

SUMMARY OF THE INVENTION

It is therefore an object of the present invention to provide an apparatus which provides storage space for the various accessories used by a golfer. More particularly, it is an object of the invention to provide an apparatus which can be attached to any belt worn by a golfer or to the golfer's pants.

It is also an object of the invention to provide a golf accessory organizer which has a plurality of storage spaces provided for golf tees, divot repair tools, ball markers, golf pencils, golf score cards and/or yardage information pad, golf balls, and hook and loop fastener (Velcro) surface for a golf glove and towel.

It is a further object of the invention to provide a golf accessory organizer which allows a space for an advertiser to insert their logo and/or message to use the golf accessory organizer as an identification or promotional item.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent in those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

BRIEF DESCRIPTION OF THE DRAWINGS

The invention will be better understood and the objects other than those set forth above will become apparent when consideration is given to the following detailed description thereof. Such description makes reference to the annexed drawings wherein.

DETAILED DESCRIPTION OF PREFERRED EMBODIMENTS

Figure 1:
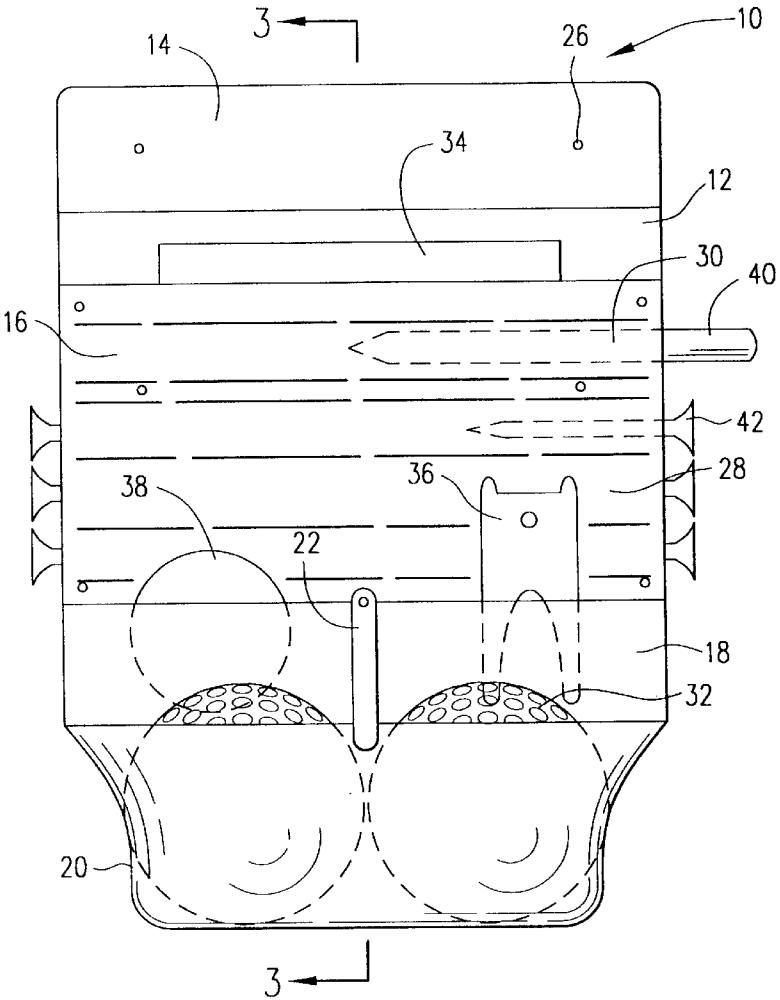
FIG. 1 is a front view of the present invention.
Figure 5:
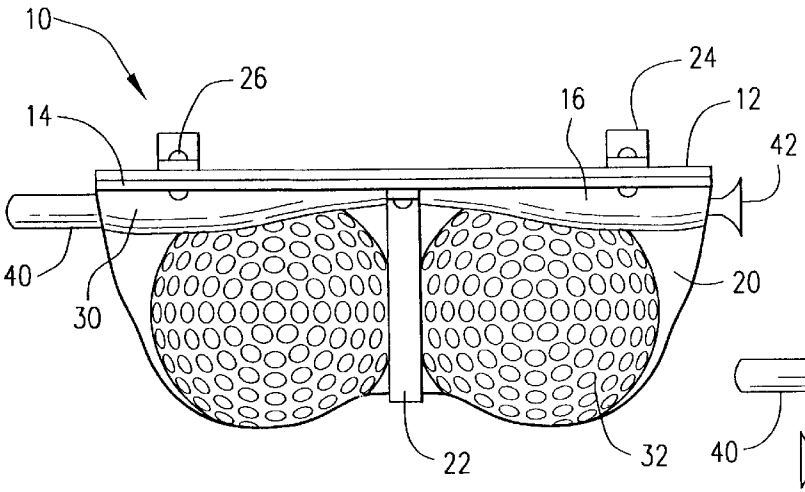
FIG. 5 is a top view of the present invention.
Figure 6:
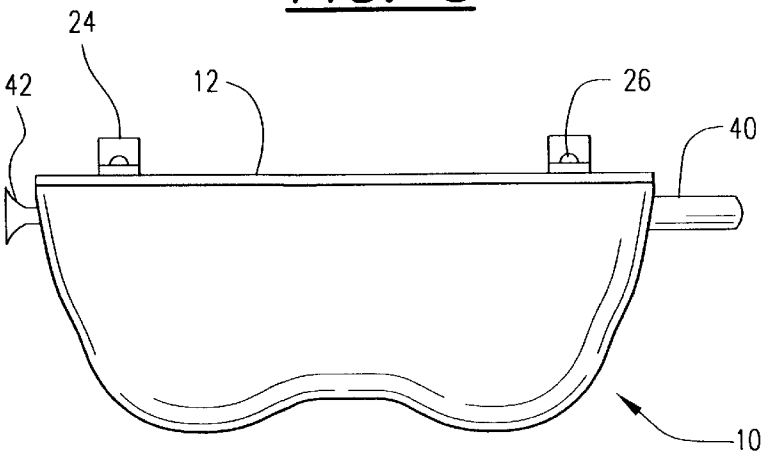
FIG. 6 is a bottom view of the present invention.

Referring now descriptively to the drawings, in which similar referenced characters denote similar elements throughout several views, FIG. 1 generally illustrates the operation of the present invention. The accessory organizer 10 is comprised primarily of a back panel 12, top panel 14, a hook and loop fastener panel 16, and an accessory panel 18, and a golf ball panel 20. The cooperation of these various panels can best be understood by referring to FIGS. 2, 3 and 5, respectively. The back panel 12 is the primary member of the present invention. Depending on the application, the back member 12 may be formed of a rigid, semi-rigid, or flexible material. Appropriate materials include injection molded or formed plastics, natural materials, such as cotton, linen and leather, preferably covering a cardboard material for increased rigidity, synthetic materials, such as nylon or rayon fabrics, Goretex®, and various other materials. Depending upon the usage it may be preferable to have the panel either flexible or rigid. Attached near a top portion of the back member 12 is a logo panel 14. The logo panel 14 provides a space for an advertiser to place promotional phrases such as the advertiser's name, logo, address, and telephone number. In addition, the logo panel 14 could be used as additional space for storage or additional hook and loop fastener. If used for storage, it would operate like the accessory panel 18 and if hook and loop fastener, would provide a larger surface or area to hold a golf towel, golf glove or other accessories.

Figure 2:
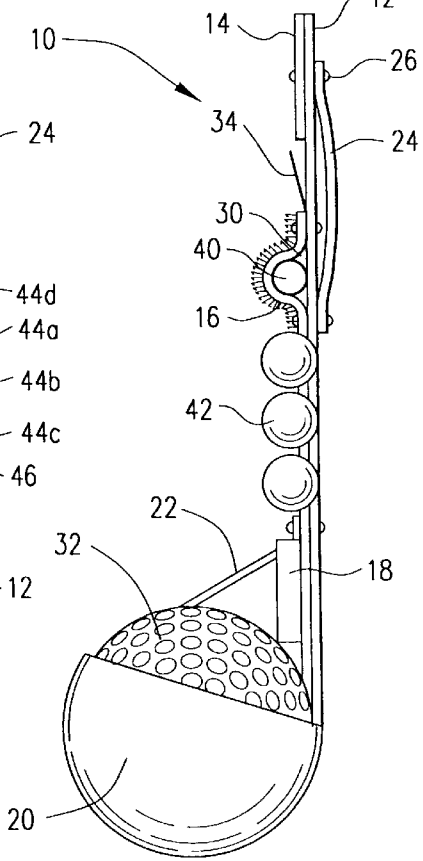
FIG. 2 is a side view of the present invention.

Hook an loop fastener panels 16 and possibly 14 are attached to the back member 12 near its center. The hook and loop fastener panel 16 is attached so as to form folds therein defining tee storage areas 28 and pencil storage area(s) 30. These storage areas can best be seen in FIG. 3, which is a cross sectional side view. In FIG. 2, the tees are inserted into the tee storage areas 28 obscuring the tee storage areas themselves. This is not true of the pencil storage area 30 in FIG. 2, because the pencil 40 is of uniform diameter down its length so that the pencil storage area 30 can be seen in FIG. 2. The hook and loop fastener panel may be a single layer or it may be a hook and loop fastener layer backed with a nylon material or other suitable fabric materials. It is not material to the invention whether the hook or the loop portion of a hook and loop fastener is used for the hook and loop fastener panel 16. However, when the present invention is used with a golf towel with a hook and loop fastener attached, the opposite portions must be present on the golf towel and is present on a golf glove and the hook and loop fastener panel 16 (and possibly 14) so that they releasably engage one another. Other golf accessories, such as a golf shoe spike or club face cleaner, and the like, may also be provided with a hook and loop fastener to be displayed on the velcro panel 16 or in a space provided. An accessory panel 18 is disposed substantially below the hook and loop fastener panel 16. The accessory panel defines a compartment therein for receiving a ball marker 38, a divot repair tool 36, and other relatively flat golf accessories.

Finally, a golf ball panel 20 is disposed below the accessory panel 18. The golf ball panel 20 is composed of a stretchable fabric-type material. The panel may be composed of a net-like material. Attached near a center portion of the golf ball panel 20 is a golf ball panel strap 22. When no golf balls 32 are inserted into the golf ball panel 20, it retracts back into a space that is smaller than indicated in FIGS. 1 through 6. The stretchable material expands as a golf ball is inserted to tolerate the golf ball and hold it snugly in the golf ball panel 20. The golf panel strap 22 helps insure that the golf ball panel 20 does not become overly stretched toward its center and helps retain the golf balls 32 more firmly in the golf ball panel 20.

To this point it has not been discussed how the various panels are fastened to the back member 12. FIGS. 1 through 6 show use of fasteners 26, which are intended in the drawings to be some sort of rivet-type device. Rivet-type devices will preferably be used at stress points on the panels where additional strength needs to be imparted to the connection between the various panels. It is also anticipated that stitching (not shown) will be used to attach the various panels, one to another. Glue, adhesives, and the like may also be used to attach the panels, one to another. The precise method of attaching the panels, one to another, is not particularly relevant to the invention, so long as the attachment is sufficiently secure to hold up to being stretched out to place various golf accessories in the pockets formed and defined by the panels. As can be seen particularly in FIG. 3, the hook and loop fastener panel 16 is attached or glued at various attachment points 44 for the purpose of defining tee storage areas 28, and pencil storage areas 30. Again, the method of creating these attachment points 44 is not relevant to the invention. It is anticipated, however, that these attachment points would be sewn onto the back member 12.

A score card and/or yardage information pad 34 is shown inserted into a score card and/or yardage information pad pocket 46 defined between a hook and loop fastener panel 16 and the back member 12. The score card and/or yardage information pad panel 46 can best been seen in FIG. 3. The score card panel 46 is defined between the back panel 12 and the hook and loop fastener panel 16.

Figure 3:
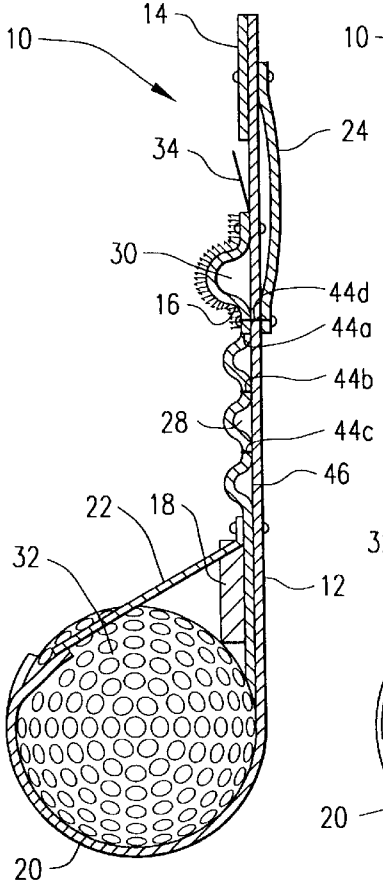
FIG. 3 is a cut away side view of the present invention along lines 3—3 in FIG. 1.
Figure 4:
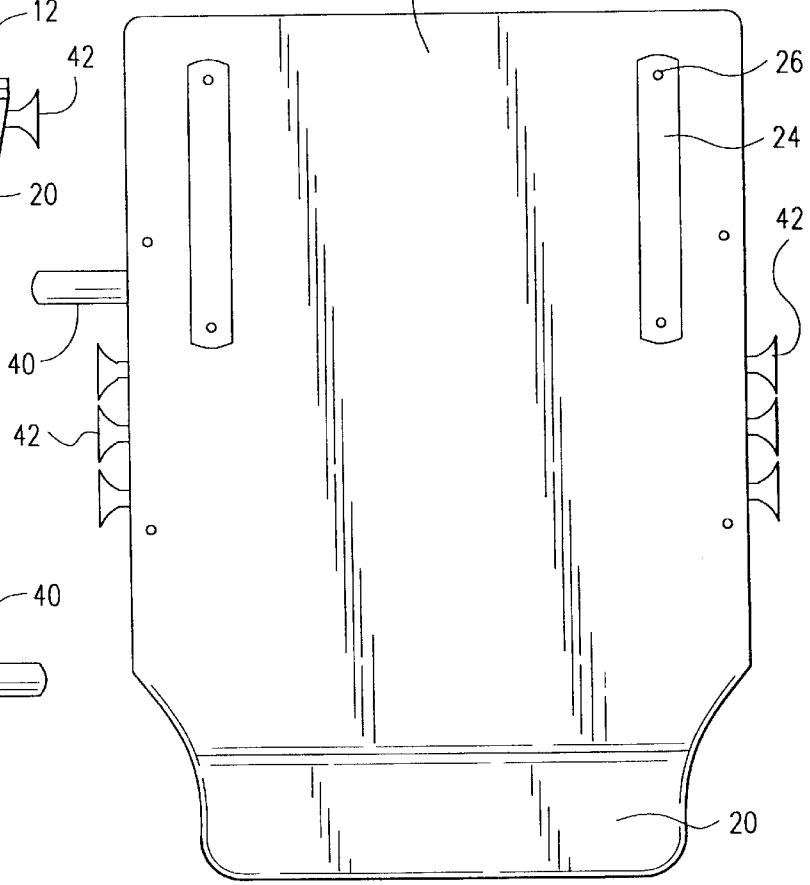
FIG. 4 is a back view of the present invention.

Belt loops 24 for attaching the golf pocket organizer 10 to the belt of a user (not shown), are illustrated in FIGS. 3 and 4. Two belt loops 24 are shown attached to the back of the back member 12. These belt loops 24 are attached so as to define a space between the belt loop 24 and the back member 12 for receiving the belt of user. As shown, the belt loops are integrally connected to the back member 12. However, it may be advantageous to provide a snap opening for the belt loops to they can be snapped open, placed around the belt of a user, then snapped back shut without the user having to remove his belt to attach the organizer. Alternatively, it may be advantageous for a clip, either mounted fixedly or removably, on the back member 12, for allowing releasable attachment of the organizer 10 to the belt or pants of a user. The clip (not shown), would be attached by means of hook and loop fastener, snaps, buttons, and the like. It would have the form of a closed c-shaped bracket which would releasably engage the pants or belt of a user. Other forms of clips attaching accessories to belts and/or pants are well known, and are intended to be incorporated herein.

OPERATION OF APPARATUS

In operation, the organizer 10 typically is attached to a golfer's belt. The golfer passes his belt through the belt loops 24 as he puts on his belt. The golfer then inserts the various accessories he needs, e.g., his score card and/or yardage information pad, golf pencils, tees, divot repair tool, ball markers, golf towel, golf glove, spike or club cleaner and extra golf balls, into the appropriate storage spaces in the organizer 10. A golf towel and golf glove with a hook and loop fastener strip attached thereto may be suspended from the hook and loop fastener panel 14 and/or 16 as well as a golf glove. The golfer can then easily retrieve the desired accessories as he needs them from the organizer.

Having thus described the field of the invention, the prior, the attached drawings, the summary of the invention, and the detailed description of the preferred embodiments,

I claim:

1. A golf accessory organizer comprising:

a. a back panel;

b. a means for attaching a back panel to a golfer's clothing;

c. a logo panel, visible at the golfer's belt level or pant waist;

d. a hook and loop fastener panel attached below the logo panel so as to define compartments for receiving round golf accessories, the exposed surface of the hook and loop fastener panel adaptable to releasably engage hook and loop fastener components on golf accessories to be attached thereto;

e. an accessory panel below the hook and loop fastener panel defining a pocket therein for receiving golf accessories; and f. a golf ball panel at a bottom of the back panel defining a pocket therein for receiving at least one golf ball.

2. The organizer of claim 1 wherein the attaching means are a pair of belt loops attached to a back side of the back panel through which a golfer's belt is to be passed for attachment of the organizer thereto.

3. The organizer of claim 1, the hook and loop panel adapted to releasably engage a corresponding hook and loop fastener on a golf glove.

4. The organizer of claim 1, the hook and loop panel adapted to releasably engage a corresponding hook and loop fastener on a golf towel.

5. The organizer of claim 1, the hook and loop panel adapted to releasably engage a corresponding hook and loop fastener on a golf club face cleaner.

* * * * *